United States Patent [19]

Palau et al.

[11] Patent Number: 4,702,286

[45] Date of Patent: Oct. 27, 1987

[54] SHED FORMING DEVICES IN WEAVING LOOMS INCLUDING PIVOTABLE RETAINING HOOKS

[75] Inventors: Joseph Palau, Duingt; Dario Bassi, Corbas, both of France

[73] Assignee: Etablissments Staubli-Verdol, Chassieu, France

[21] Appl. No.: 896,266

[22] Filed: Aug. 14, 1986

[30] Foreign Application Priority Data

Sep. 6, 1985 [FR] France ..... 85 13435

[51] Int. Cl.[4] ..... D03C 13/00; D03C 3/00; D03C 3/06

[52] U.S. Cl. ..... 139/455; 139/59; 139/65

[58] Field of Search ..... 139/59, 65, 455, 55.1, 139/317, 319, 320

[56] References Cited

U.S. PATENT DOCUMENTS

| | | | |
|---|---|---|---|
| 1,678,325 | 7/1928 | Butin et al. | 139/319 |
| 3,103,953 | 9/1963 | Lauritsen | 139/455 |
| 3,835,894 | 9/1974 | Speich | 139/455 |
| 3,938,560 | 2/1976 | Lauritsen | 139/59 |
| 4,515,186 | 5/1985 | Durville et al. | 139/65 |
| 4,532,963 | 8/1985 | Bastion et al. | 139/59 |
| 4,593,723 | 6/1986 | Griffith | 139/65 |

FOREIGN PATENT DOCUMENTS

| | | | |
|---|---|---|---|
| 1906109 | 8/1970 | Fed. Rep. of Germany | 139/59 |

*Primary Examiner*—Harvey C. Hornsby
*Assistant Examiner*—Joseph S. Machuga
*Attorney, Agent, or Firm*—Dowell & Dowell

[57] ABSTRACT

This invention relates to the shed forming devices in weaving looms wherein each of the retaining hooks is in the form of an element which is pivotable about a horizontal pin with each element provided with a tail portion which is subjected to the reaction of a compression spring so that the head portion thereof lies in a rest position above the toe of a corresponding mobile hook. When the mobile hook causes a retaining hook to pivot so that its nose or head is in an outer position with respect to the toe, an electromagnet of the device may be selectively activated to retain the retaining hook in this outer position to thereby prevent the mobile hook from being restrained by the retaining hook.

2 Claims, 7 Drawing Figures

SHED FORMING DEVICES IN WEAVING LOOMS INCLUDING PIVOTABLE RETAINING HOOKS

BACKGROUND OF THE INVENTION

1. Field of the Invention

The present invention relates to a shed forming device in a weaving loom comprising a tilting retaining hook.

2. History of the Art

It is known that, in shed forming devices in a weaving loom, a system may be used for lifting each harness cord which is composed of two mobile hooks each fastened to the end of a funicular element which cooperates with a lifting beam associated with the harness cord. The two mobile hooks are lifted and lowered alternately by knives provided in the shed forming device, whilst elastic blades having a curved end, associated with an electromagnet, are urged into the upper part of each system in order to selectively retain the corresponding hook in high or top dead center position.

One of the ends of the blades in question must be embedded in a block, while its other curved end cooperates with the corresponding hook. The blades are made of spring steel so as to be elastic. It will be readily appreciated that such an arrangement is not reliable, as the spring blades are subjected to continual, very high-rate bending moments when controlling warp yarns of a high-speed weaving loom. These blades therefore break frequently, bringing about a shut down of the equipment, thus leading to an increase in production costs, without counting the actual costs of repair.

In addition, it will be appreciated that as the elastic blades are reduced in cross section due to wear the value of the flux which passes therethrough, will be correspondingly reduced, so that the power of each electro-magnet is reduced.

Finally, the blades are made of spring steel, such as a carbon steel, with the result that they may be detrimental to the correct operation of the system.

SUMMARY OF THE INVENTION

It is an object of the improvements forming the subject matter of the present invention to overcome the above drawbacks of the fixed hooks of conventional shed forming devices and to produce a rigid retaining hook of economical manufacture, of reliable operation and which ensures a non-reduced passage of the magnetic flux.

To this end, the retaining hooks according to the invention are made in the form of elements which pivot about an axis oriented perpendicularly to the direction of displacement of the mobile hooks, which element is provided with a tail portion subjected to the reaction of a compression spring which maintains this tail remote from the electro-magnet as long as the inclined head of the hook is not actuated by the corresponding mobile hook. In this way, in rest position, the inclined head of each retaining hook lies opposite the toe of the corresponding mobile hook. When the mobile hook causes the retaining hook to pivot so as to urge its tail portion against the electro-magnet, if the electromagnet is energized, the fixed hook is maintained in pivoted position with its head in retracted position outwardly with respect to the toe of the corresponding mobile hook. In this way, the corresponding mobile hook is not retained ina high or top dead center position.

According to a preferred embodiment of the above arrangement, the two retaining hooks of each system are controlled by a single electro-magnet.

Each mobile hook comprises an elastic tongue whose end face is inclined in the same direction as the end wall of the corresponding fixed pivoting hook, so that, at the end of the stroke of each mobile hook in the direction of the corresponding retaining hook, the inclined part of the retaining hook comes into abutment against the outer longitudinal edge of the tongue after having been placed beneath the toe of the mobile hook.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
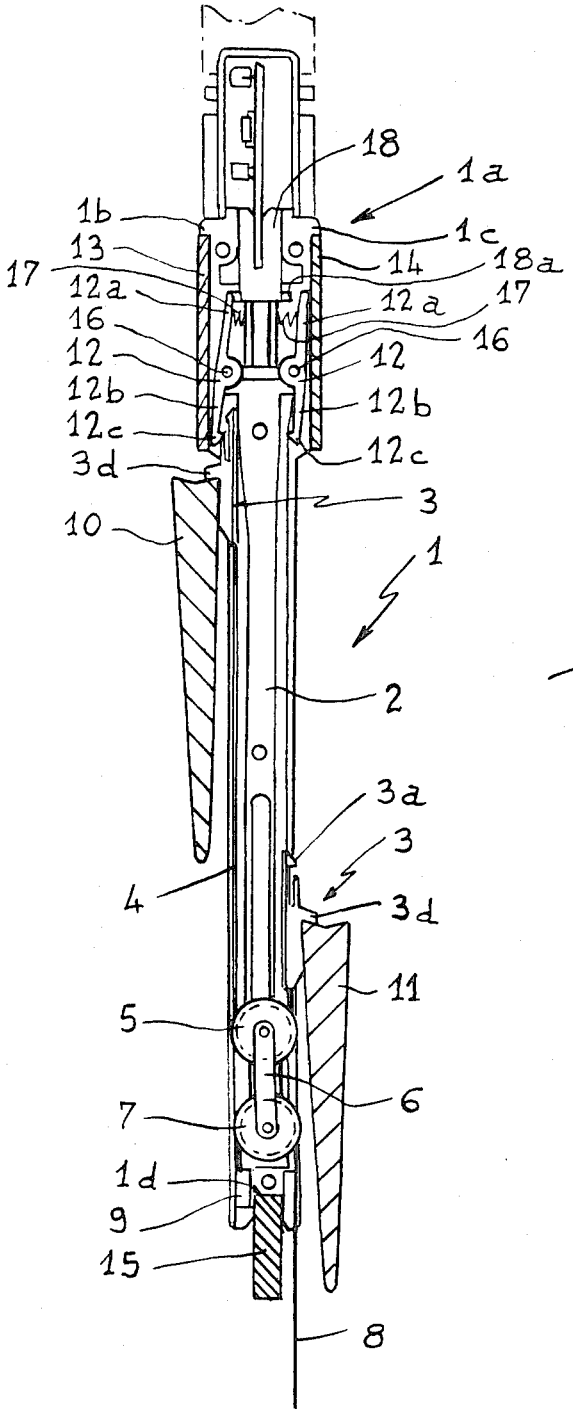
FIG. 1 is a transverse section of a shed forming device to which the improvements according to the invention are applied.

With continued reference to the drawings a shed forming device in a weaving loom comprises a plurality of systems 1 for lifting the warp yarns, each of them being disposed between two separating partitions 2. The system comprises two mobile hooks 3, associated at each of the ends with a funicular element 4 passing around a pulley 5 of a lifting beam 6 having another pulley 7 which is surrounded by the harness cord 8 which is anchored by one of its ends to a fixed point 9. Each of the hooks 3 is alternately displaced in reciprocating motion by means of knives 10, 11 manipulated by reciprocating movements. In this way, each hook is alternately brought to the level of the head 1*a* of the system 1 where it may be gripped by a retaining hook 12 according to the invention.

It will be observed that each system 1 is positioned with respect to two transverse bars 13 and 14 against which shoulders 1*b* and 1*c* of the system abut, while a notch 1*d* in the bottom of the system rests against a crosspiece 15 or vice versa.

As is more particularly illustrated in FIGS. 2 to 7, each retaining hook 12 is mounted to pivot about a pivot pin 16 oriented perpendicularly to the path of the mobile hooks 3, i.e. it is in fact in horizontal position in the example illustrated, and the pin is retained by the two separating partitions 2 of each system 1. Each hook 12 therefore comprises a central boss provided with a bore through which pin 16 passes. Each hook 12 is further provided with a tail 12*a* oriented upwardly, and with a head 12*b* facing downwardly and provided with a bent end or nose element 12*c*. A compression spring 17 is placed between the tail 12*a* and a fixed stop of the head 1*a* so that the bent end or nose element 12*c* of the hook lies, corresponding edge 36 of the in free position, opposite the toe 3*a* of the corresponding fixed hook 3. An electro-magnet 18 placed in the head 1*a* and includes core 18*a* which lies opposite the end of the tail 12*a* of hook 12. The terminal edge 12*d* of the head 12*b* of the hook 12 is oblique in the same direction as the corresponding edge 3*b* of the toe 3*a* of hook 3.

It will be noted that each mobile hook 3 includes an elastic tongue 3*c* oriented in the direction of displacement of the hook and whose role will be better described hereinafter.

Operation follows from the foregoing explanations.

Figure 2:
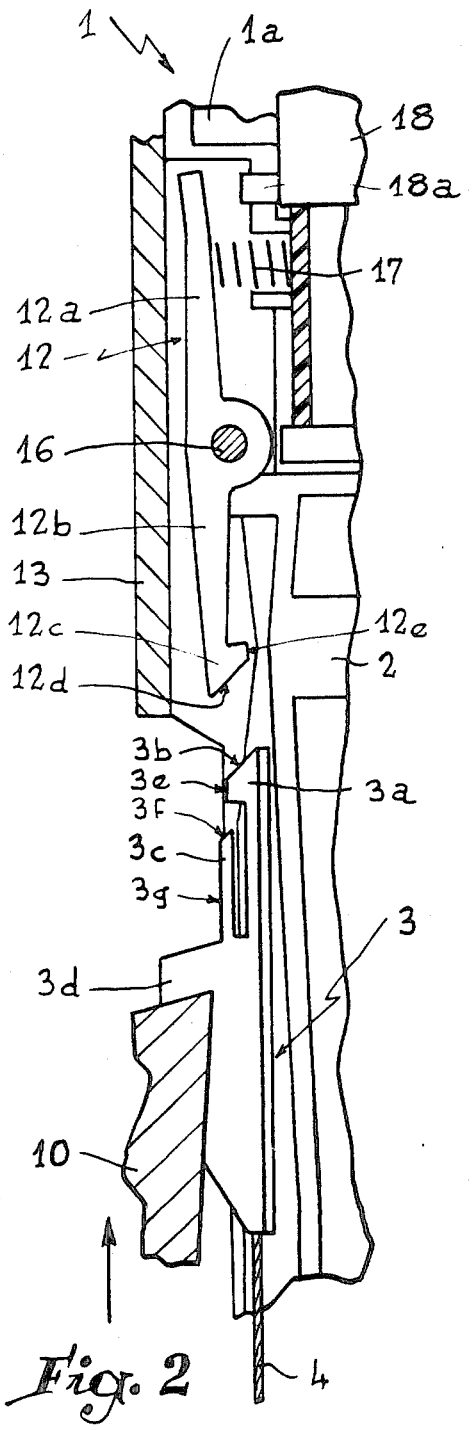
FIGS. 2 to 7 illustrate in detail on a larger scale the operation of the retaining hook of the device according to the invention.
Figure 3:
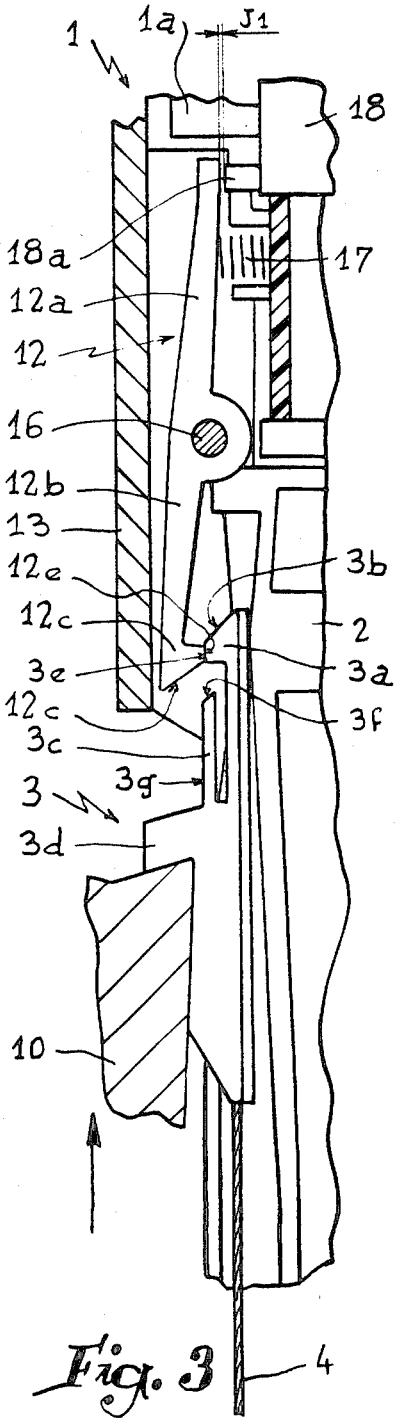
Figure 4:
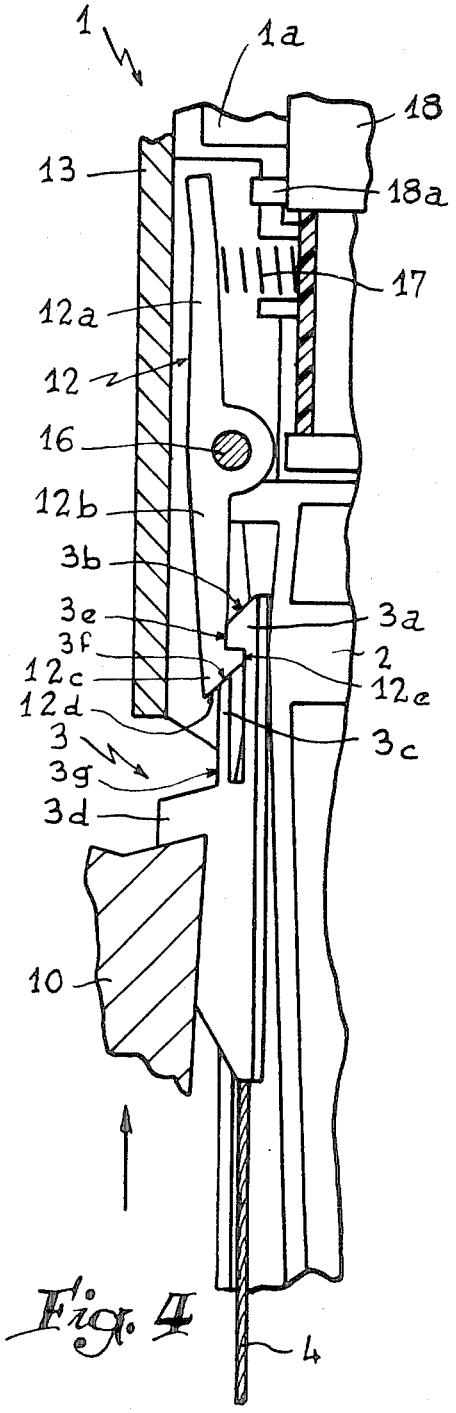
Figure 5:
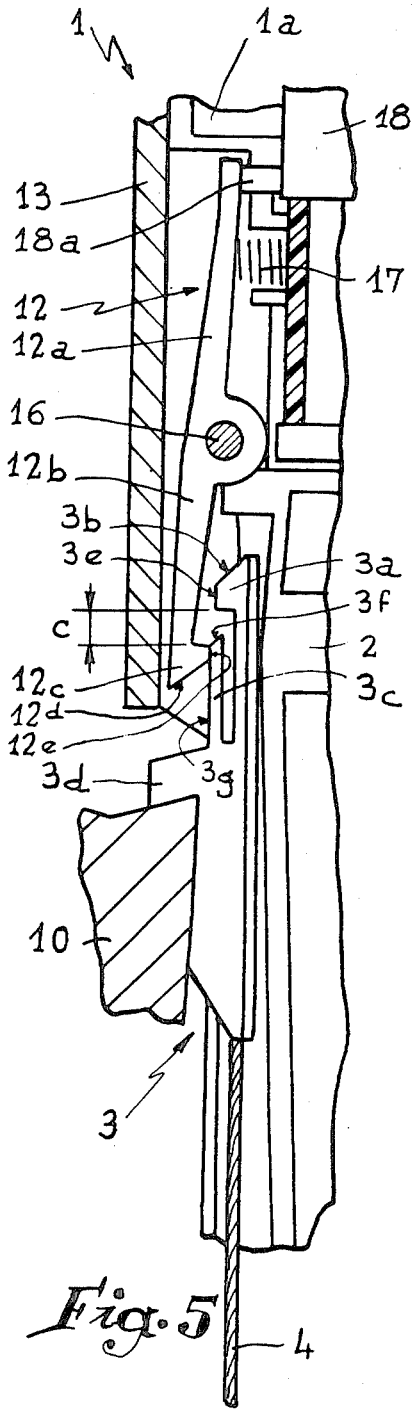

As illustrated in FIG. 2, in rest position, hook 12 is in a pivoted position due to the force or action of spring 17, with the result that the edge 12*d lies opposite edge 3b* of the toe 3*a* of hook 3. During the lift of the knife 10 with which each hook 3 is associated by an oblique lateral nose element 3*d* and, towards the lift end of the movement, the end edge 3*b* of the toe 3*a* of each hook 3 comes into contact with edge 12*d* of the head 12*b* of the corresponding retaining hook 12, so that the corresponding slope of these two edges initiates a pivotting of hook 12 in clockwise direction until the two end walls 12*e* and 3*e* of the two hook members in question engage one another, as illustrated in FIG. 3. At that moment, it is observed that the tail 12*a* of the hook 12 is not yet in abutment against the core 18*a* of the electromagnet 18 (cf. clearance $J_1$). As the stroke of the mobile hook 3 continues, under the effect of the reaction of spring 17, the nose element 12*c* of the head 12*b* of the fixed hook 12 comes into engagement under the toe 3*a* of the hook 3, as shown in FIG. 4. As this position lies slightly before the top dead centre of the stroke of each hook 3, as the hook 3 rises a little more, the edge 3*f* of the tongue 3*c* causes hook 12 to pivot due to the slope of the edge 12*d* of this hook 12. As the stroke continues the end wall 12*e* of the hook 12 comes into engagement with the outer lateral wall 3*g* of the elastic tongue 3*c* of hook 3. This wall lies, as illustrated, outwardly of the end face 3*e* of hook 3. Because of its elasticity, tongue 3*c* therefore maintains the tail 12*a* of the corresponding hook 12 in abutment against the core 18*a* of the electromagnet, in order to insure that the contact there between is perfect regardless of any wear between the parts. The representation of FIG. 5 corresponds to the top dead centre of the stroke of hook 3.

Figure 7:
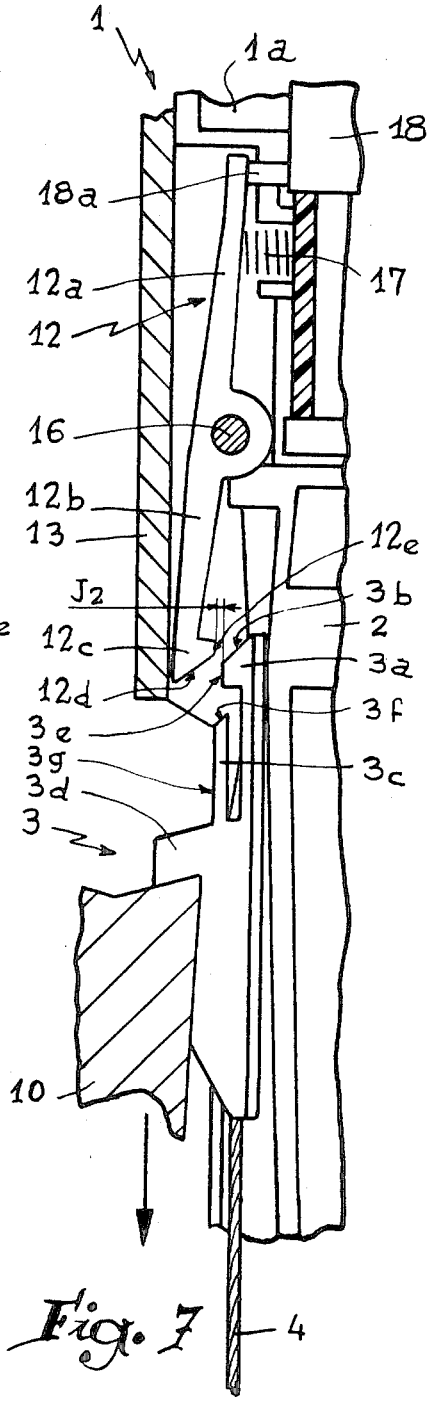

If the selection of the shed forming device necessitates that hook 3 does not remain in a high or top dead center position, the electro-magnet is energized, with the result that the tail 12*a* of the fixed hook 12 is retained or urged against the core 18*a* of the electromagnet. When knife 10 descends, the toe 3*a* of hook 3 escapes from the nose element 12*c* of head 12*b* of hook 12, as illustrated in FIG. 7. It will be observed that, in this position, the end wall 12*e* of the head 12*c* lies outside the outer face 3*e* of the toe 3*a* of hook 3, with a clearance $J_2$ there between.

Figure 6:
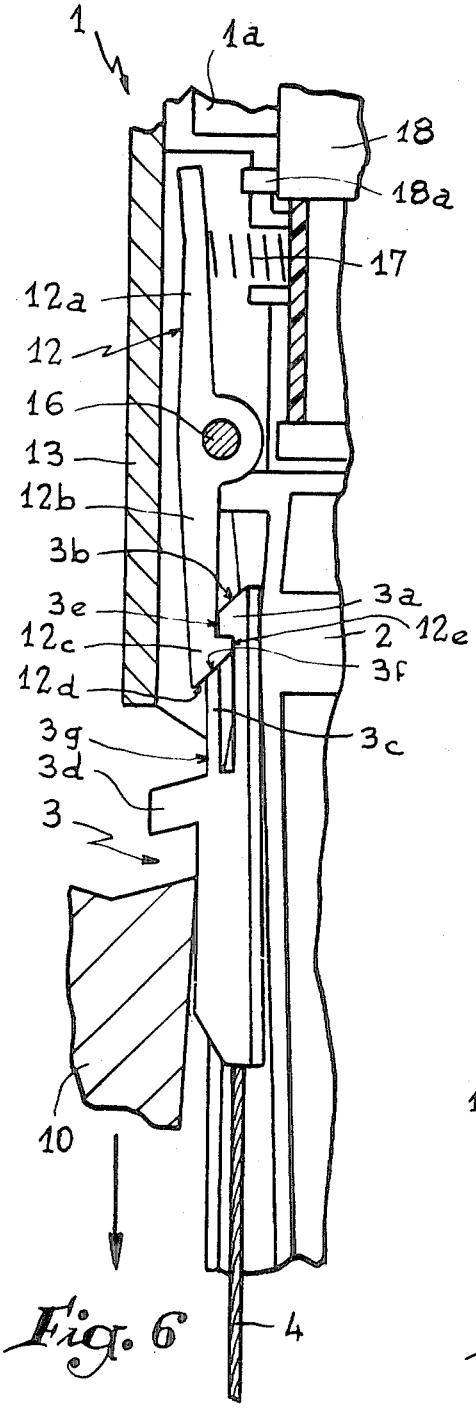

However, if hook 3 must remain in a high or top dead center position, electro-magnet 18 is not energized, so that, during the downward stroke of knife 10, the end wall 12*e* of nose element 12*c* of the head 12*b* of hook 12 slides against the lateral wall 3*g*, then against the edge 3*f* of the tongue 3*c* of hook 3, so that it comes, as illustrated in FIG. 6, into engagement beneath toe 3*a* of the mobile hook 3, under the influence of the reaction of the compression spring 17. The knife 10 continues to descend to its bottom dead centre position from which it rises again to cooperate with the lateral nose element 3*d* of the hook 3. The hook 3 effects an upward stroke as a dimension c (FIG. 5) from the position of FIG. 4 in order to bring the nose element 12*c* of hook 12 against the lateral wall 3*g* of tongue 3*c*. Then, during the descent of knife 10, depending on whether or not the electro-magnet is energized, hook 3 will be free to redescend or will remain hooked to hook 12.

In the preferred embodiment, the electro-magnet is unique for each system 1, i.e. when the electromagnet is energized, it may retain either one or the other of the two hooks 12, when their tail 12*a* is applied against its respective core 18*a*.

It must, moreover, be understood that the foregoing description has been given only by way of example and that it in no way limits the domain of the invention which would not be exceeded by replacing the details of execution described by any other equivalents.

Although the foregoing description relates to a vertical orientation of system 1, it will be readily appreciated that it may be disposed in any other direction without departing from the scope of the invention.

What is claimed is:

1. An apparatus for lifting the warp yarns in a shed forming device for weaving looms comprising partition means, a pair of mobile hooks oppositely oriented on opposite side of said partition means, each of said mobile hooks having a toe portion, a funicular element extending between said pair of mobile hooks so that said mobile hooks are manipulated between first and second positions by said funicular element, a pair of fixed hooks oriented in opposing relationship of opposite sides of said partition means so as to be in general alignment with one of said pair of mobile hooks, each of said fixed hooks having a head portion and a tail portion, pin means intermediate said head and tail portions of said fixed hooks for pivotally securing said fixed hooks to said partition means, an electromagnetic means carried by said partition means and adjacent said tail portions of said fixed hooks, spring means mounted between said fixed hooks and said partition means and adjacent said tail portions of said fixed hooks so as to urge said fixed hooks into a rest position in which the head portions thereof are in substantial alignment with the toe portions of said mobile hooks, each head portion of each of said fixed hooks including a nose portion which extends inwardly toward said partition means and an outermost inclined terminal edge portion, each of said mobile hooks having an elastic tongue oriented in the direction of one of said fixed hooks, each of said elastic tongues including an outer face which is offset outwardly of said toe portions of said mobile hooks, each of said toe portions of said mobile hooks including an inclined outer edge which is engagable with one of said inclined terminal edge portion of said fixed hooks to thereby pivot said fixed hooks so that the tail portions thereof are urged toward said electromagnetic means.

2. The apparatus of claim 1 in which each of said outer faces of said elastic tongues of said mobile hooks is inclined so as to complementary engage the inclined terminal edge portion of said fixed hooks so as to thereby urge said tail portions of said fixed hooks into abutment with said electromagnetic means and to simultaneously pivot said head portion of said fixed hooks to a second position which is spaced outwardly from said rest position whereby said toe portions of said mobile hooks may pass between said head portions of said fixed hooks and said partition means and wherein said electromagnetic means selectively retains said fixed hooks with said head portions in said second position.

* * * * *